US011801675B2

(12) United States Patent
Hausmann et al.

(10) Patent No.: US 11,801,675 B2
(45) Date of Patent: Oct. 31, 2023

(54) CONTROLLER AND METHOD FOR OPERATING A PRINTING DEVICE GIVEN THE PRESENCE OF A RECORDING MEDIUM ELEVATION

(71) Applicant: Canon Production Printing Holding B.V., Venlo (NL)

(72) Inventors: Bernd Hausmann, Maisach (DE); Hubert Drexler, Taufkirchen (DE); Bernhard Holzner, St. Wolfgang (DE); Stephan Pilsl, Röhrmoos (DE); Ulrich Bäumler, Poing (DE); Lucian Petrut, Poing (DE); Christian Wallis, Munich (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 17/587,752

(22) Filed: Jan. 28, 2022

(65) Prior Publication Data

US 2022/0234349 A1 Jul. 28, 2022

(30) Foreign Application Priority Data

Jan. 28, 2021 (DE) ..... 102021101892.7

(51) Int. Cl.
*B41J 11/00* (2006.01)
*B41J 2/045* (2006.01)
*B41J 29/393* (2006.01)

(52) U.S. Cl.
CPC ..... *B41J 2/04556* (2013.01); *B41J 11/0095* (2013.01); *B41J 29/393* (2013.01)

(58) Field of Classification Search
None
See application file for complete search history.

(56) References Cited

U.S. PATENT DOCUMENTS

| | | | |
|---|---|---|---|
| 9,004,635 | B2 | 4/2015 | Biglari et al. |
| 2011/0279508 | A1 | 11/2011 | Naito |
| 2011/0279510 | A1 | 11/2011 | Takeuchi et al. |
| 2021/0039410 | A1 | 2/2021 | Lang |

FOREIGN PATENT DOCUMENTS

| | | | | |
|---|---|---|---|---|
| DE | 102011000174 | A1 | 7/2012 | |
| DE | 102019121077 | A1 | 2/2021 | |
| JP | 2021008034 | A * | 1/2021 | ..... B41J 2/01 |

OTHER PUBLICATIONS

Hoshino, MachineTranslationofJP-2021008034-A, 2021 (Year: 2021).*
German Search Report dated Aug. 26, 2021, Application No. 10 2021 101 892.7.

* cited by examiner

*Primary Examiner* — Scott A Richmond
(74) *Attorney, Agent, or Firm* — THE WEBB LAW FIRM

(57) ABSTRACT

A controller may detect an elevation of a recording medium that is to be printed to, the elevation may result in the printing element of a printing device being negatively affected. The controller may automatically produce a time-limited printing pause of the printing element in which the printing gap between the printing element and the recording medium is temporarily enlarged in order to direct the detected elevation past the printing element. A negative effect on the printing device given the presence of a damaged recording medium may thus be efficiently and reliably avoided or reduced.

14 Claims, 4 Drawing Sheets

CONTROLLER AND METHOD FOR OPERATING A PRINTING DEVICE GIVEN THE PRESENCE OF A RECORDING MEDIUM ELEVATION

CROSS REFERENCE TO RELATED APPLICATIONS

This patent application claims priority to German Patent Application No. 102021101892.7, filed Jan. 28, 2021, which is incorporated herein by reference in its entirety.

BACKGROUND

Field

The disclosure relates to a method and a corresponding controller for operating a printing device, in particular an inkjet printing device, given detection of an elevation of the recording medium to be printed to.

Related Art

An inkjet printing device for printing to a recording medium has at least one print bar having one or more print heads, wherein each print head typically has a plurality of nozzles. The nozzles are respectively configured to eject ink droplets in order to print dots of a print image onto the recording medium.

During the printing operation, the print bar with the one or more print heads is typically arranged relatively closely, for example 2 mm or less, above the surface of the recording medium to be printed to, in order to enable an optimally high print quality. Therefore, there is the risk that an elevation of the recording medium, for example a local adhesive area of the recording medium, causes a contact between the surface of the recording medium and the nozzle plate of a print head of the printing device, which may lead to a negative effect on the print head.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
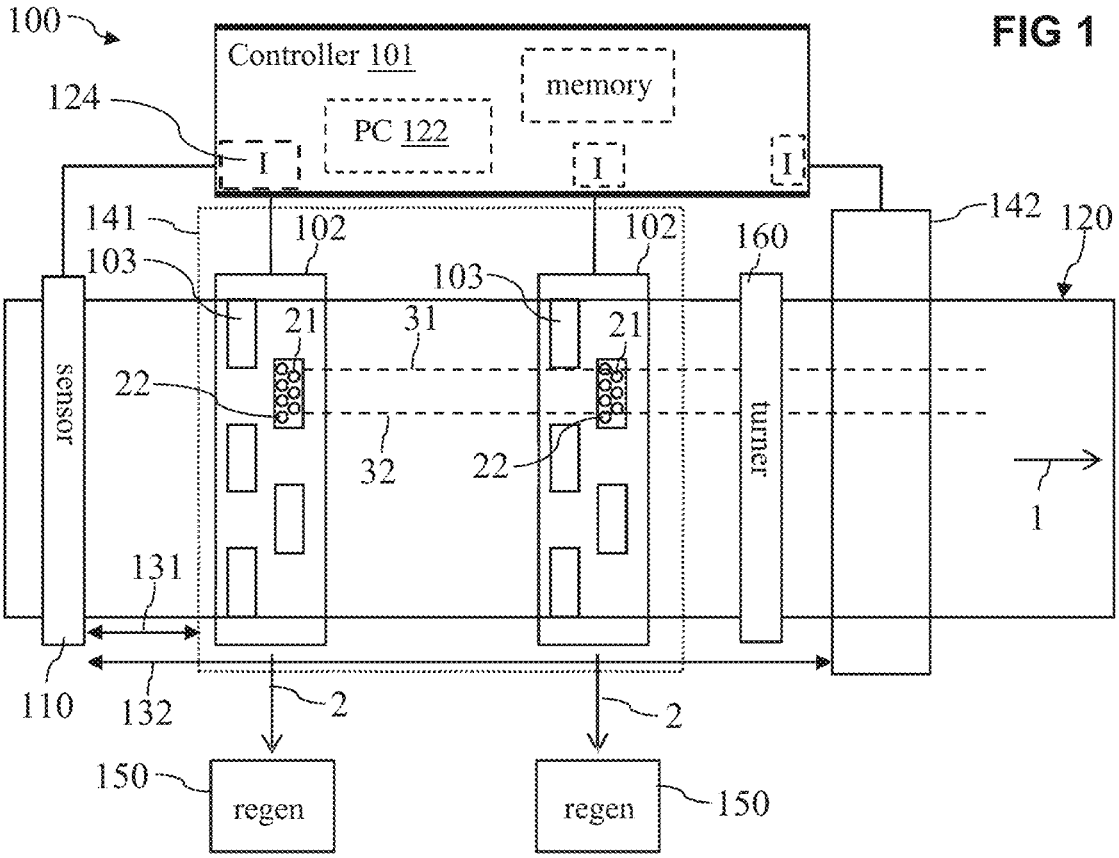

FIG. 1 a block diagram of an inkjet printing device according to an exemplary embodiment.

Figure 2A:
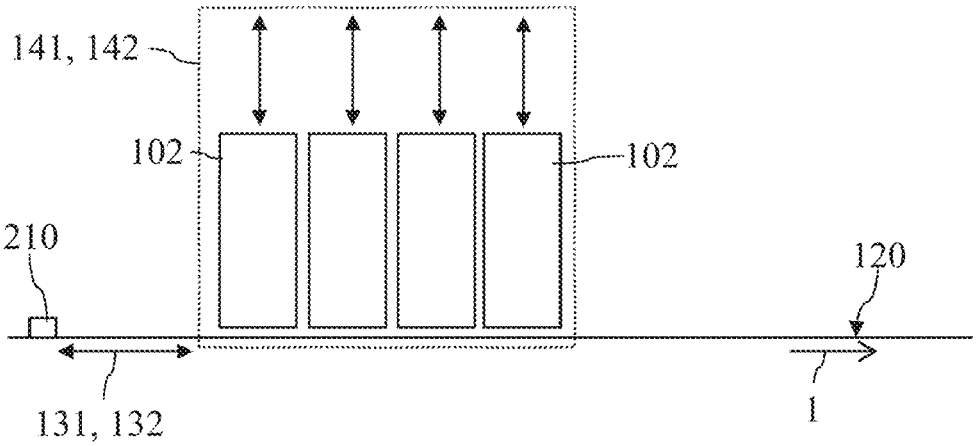
Figure 2B:
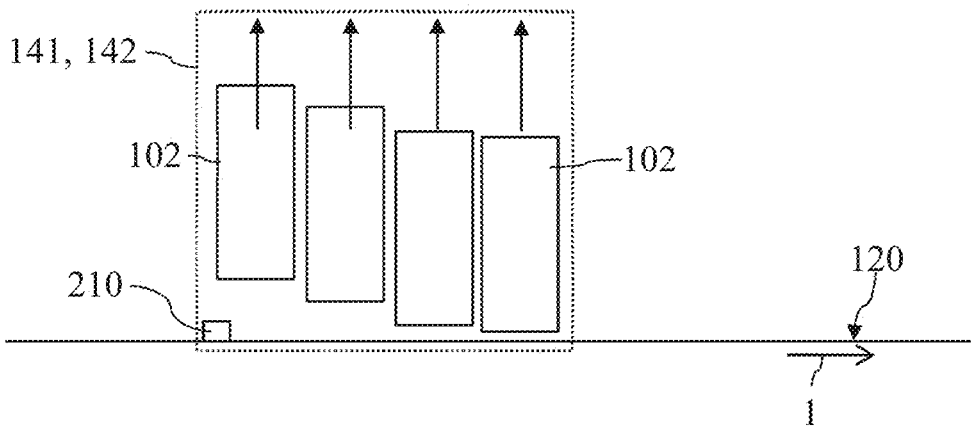
Figure 2C:
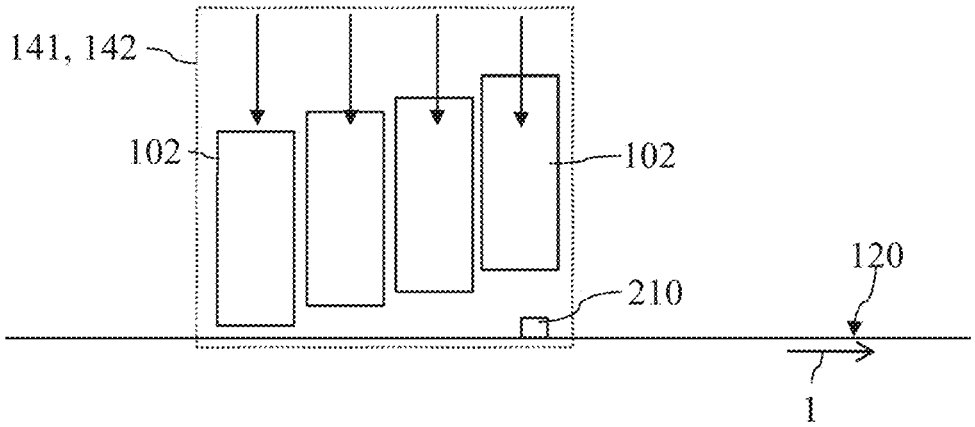

FIGS. 2*a* to 2*c* different states of a print bar upon traversing an elevation of a recording medium, according to exemplary embodiments.

Figure 3:
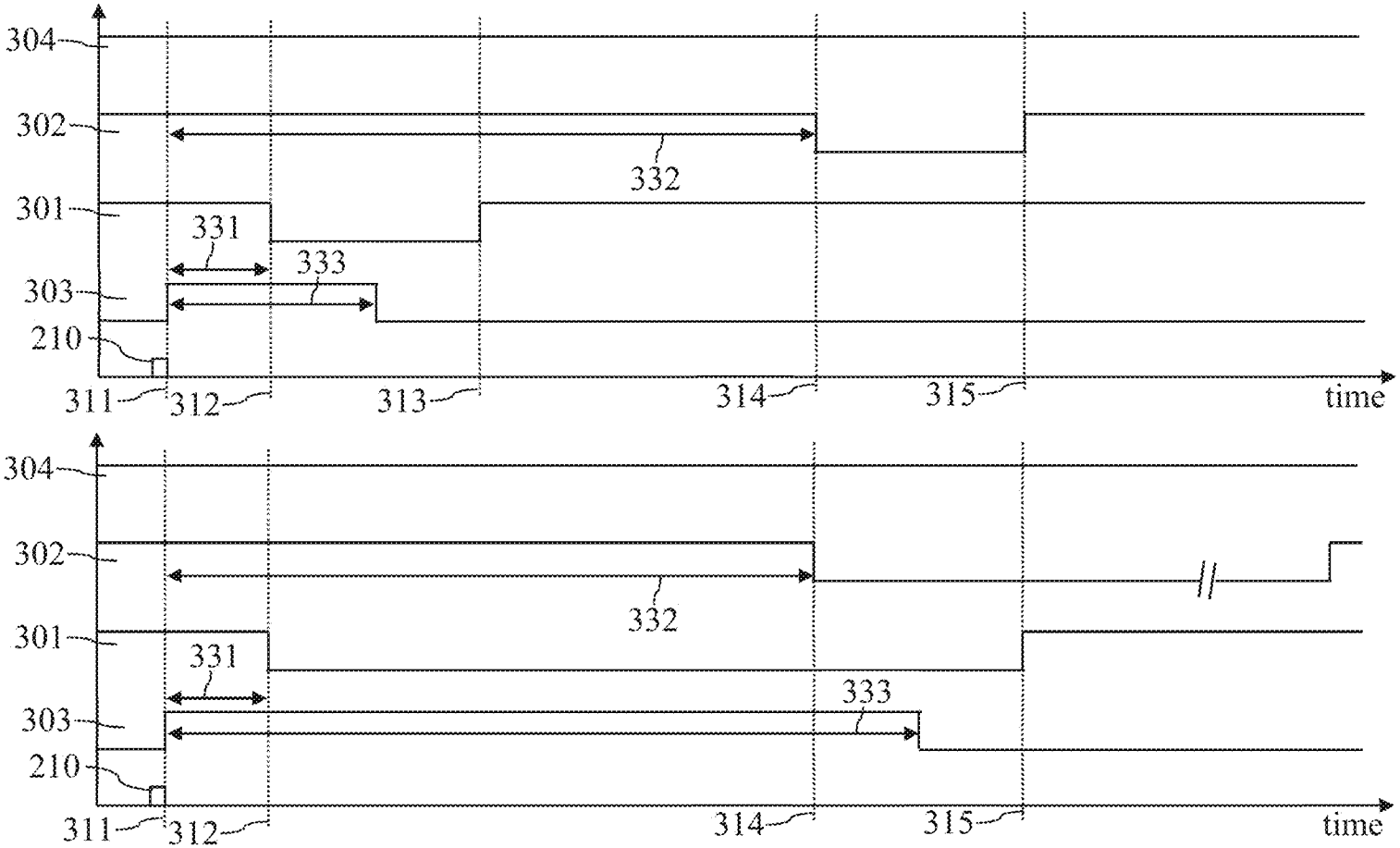

FIG. 3 plots of time diagrams for the operation of a printing device given a detected recording medium elevation according to an exemplary embodiment.

Figure 4:
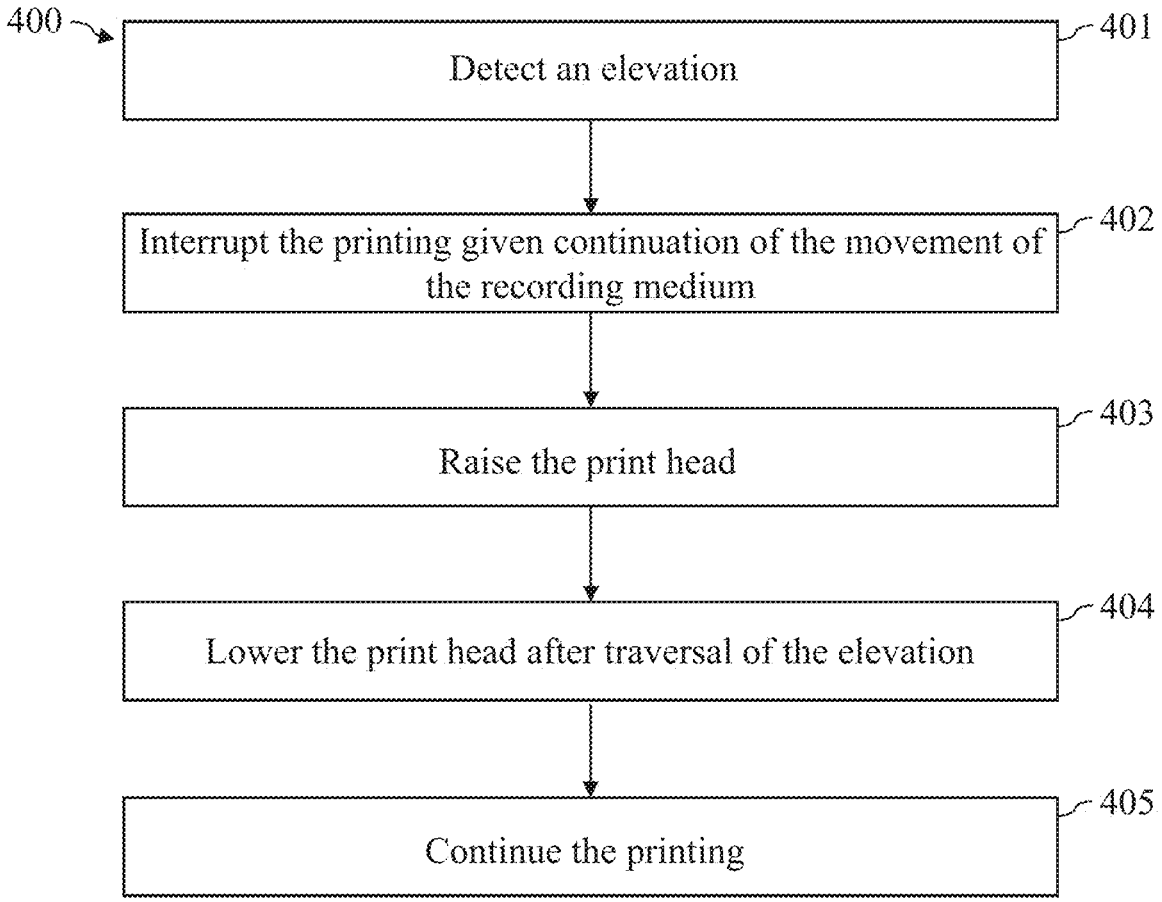

FIG. 4 a flowchart of a method for operating a printing device in reaction to a detected recording medium elevation according to an exemplary embodiment.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure. The connections shown in the figures between functional units or other elements can also be implemented as indirect connections, wherein a connection can be wireless or wired. Functional units can be implemented as hardware, software or a combination of hardware and software.

An object of the present disclosure is to efficiently and reliably protect a printing device, in particular an inkjet printing device, from a negative effect of an elevation of a recording medium to be printed to.

According to one aspect of the disclosure, a controller for controlling a printing device is described that has at least one printing unit having at least one print bar. The printing device is designed to produce a relative movement between the printing unit and a recording medium to be printed to by the printing unit, in order to print sequential lines of a usable print image onto the recording medium during the printing operation.

The controller is configured to detect an elevation of the print image to be printed to and, in reaction thereto, to produce a printing pause of the printing operation upon continuation of the relative movement between the printing unit and the recording medium. The controller is also configured to induce the effect that, during the printing pause, the printing gap between the printing unit and the recording medium is enlarged, for example by raising the printing unit, so that the detected elevation of the recording medium may be directed past the printing unit within the scope of the continued relative movement. Moreover, the controller is configured to induce the effect that the printing gap between the printing unit and the recording medium is reduced again after the detected elevation of the recording medium has been directed past the printing unit, and to resume the printing operation after the printing gap between the printing unit and the recording medium has been reduced.

According to a further aspect of the disclosure, a method is described for controlling a printing device that has at least one printing unit having at least one print bar. The printing device is designed to produce a relative movement between the printing unit and a recording medium to be printed to by the printing unit, in order to print sequential lines of a usable print image onto the recording medium during the printing operation.

The method includes the detection of an elevation of the recording medium to be printed to and, in reaction thereto, the production of a printing pause of the printing operation of the printing unit given simultaneous continuation of the relative movement between the printing unit and the recording medium. Furthermore, the method includes having the effect that, during the printing pause, the printing gap between the printing unit and the recording medium is enlarged so that the detected elevation of the recording medium may be directed past the printing unit within the scope of the continued relative movement, in particular without the elevation thereby contacting the printing unit. Moreover, the method includes having the effect that the printing gap between the printing unit and the recording medium is reduced again after the detected elevation has been directed past the printing unit. The method also includes the resumption of the printing operation of the printing unit after the printing gap between the printing unit and the recording medium has been reduced.

The printing device 100 depicted in FIG. 1 is designed for printing to a recording medium 120 in the form of a belt or web or page or sheet. The printing device 100 may, if applicable, be designed to take the recording medium 120 in the form of a web off of a roll. The recording medium 120 may be manufactured from paper, paperboard, cardboard, metal, plastic, textiles, a combination thereof, and/or other materials that are suitable and can be printed to. The recording medium 120 is transported along the transport direction 1, represented by an arrow, through at least one printing unit 141, 142 of the printing device 100.

In the depicted example, a printing unit 141, 142 of the printing device 100 comprises two print bars 102, wherein each print bar 102 may be used for printing with ink of a defined color, for example black, cyan, magenta, and/or yellow, and if applicable MICR ink. Furthermore, the printing device 100 typically comprises at least one fixing or drying unit (not shown) that is configured to fix a print image printed onto the recording medium 120.

A print bar 102 may comprise one or more print heads 103 that are possibly arranged side by side in a plurality of rows in order to print the dots of different columns 31, 32 of a print image onto the recording medium 120. In the example depicted in FIG. 1, a print bar 102 comprises five print heads 103, wherein each print head 103 prints the dots of a group of columns 31, 32 of a print image onto the recording medium 120.

In the embodiment depicted in FIG. 1, each print head 103 of a printing unit 141, 142 comprises a plurality of nozzles 21, 22, wherein each nozzle 21, 22 is configured to fire or eject ink droplets onto the recording medium 120. A print head 103 of a printing unit 141, 142 may, for example, comprise multiple thousands of effectively utilized nozzles 21, 22 that are arranged along a plurality of rows transverse to the transport direction 1 of the recording medium 120. By means of the nozzles 21, 22 of a print head 103 of a printing unit 141, 142, dots of a line of a print image may be printed onto the recording medium 120 transverse to the transport direction 1, meaning along the width of the recording medium 120.

In an exemplary embodiment, the printing device (printer) 100 also includes a controller 101, for example an activation hardware and/or a processor, that is configured to activate the actuators of the individual nozzles 21, 22 of the individual print heads 103 of the printing units 141, 142 in order to apply the print image onto the recording medium 120 depending on print data. In an exemplary embodiment, the controller 101 includes processing circuitry 122 that is configured to perform one or more functions and/or operations of the controller 101, including activating the actuators of the individual nozzles 21, 22 of the individual print heads 103 of the print group 140 to apply the print image onto the recording medium 120 based on print data, processing print and/or other data, controller one or more modes of the printer device 100 and/or controlling one or more operations of the printing device 100. In an exemplary embodiment, the controller 101 includes one or more interfaces 124 (e.g. a wired and/or wireless input and/or output interface, transceiver, or the like) that is configured to receive or output data or information. For example, the controller 101 may receive signals generated by one or more components of the printing device 100 (e.g. from a user interface of the printer device 100) and/or output control signals to one or more components of the printing device 100. In an exemplary embodiment, the controller 101 includes a memory configured to store data/information, and/or store executable code that is executable by the processing circuitry 122 to cause the processing circuitry to perform the operation(s) of the controller 101.

A printing unit 141, 142 of the printing device 100 thus comprises at least one print bar 102 with K nozzles 21, 22 that may be activated with a defined line timing in order to print a line with K pixels or K columns 31, 32—for example with K>1000—of a print image onto the recording medium 120, the line traveling transverse to the transport direction 1 of the recording medium 120. In the depicted example, the nozzles 21, 22 are installed immobile or fixed in the printing device 100, and the recording medium 120 is directed past the stationary nozzles 21, 22 with a defined transport velocity.

Furthermore, the printing device 100 may comprise one or more regenerators 150 for the corresponding one or more print bars 102 of the one or more printing units 141, 142. A print bar 102 may be transitioned from a printing position, at which the print bar 102 is arranged above the recording medium 120, into a cleaning or service position. For this purpose, the print bar 102 may be moved in the movement direction 2, indicated by an arrow. In the cleaning or service position, the nozzle plates of the one or more print heads 103 of a print bar 102 may then be cleaned, for example wiped off, using a regenerator 150. A purging of the one or more print heads 103 with ink may also take place in the regenerator 150. The printing device 100 may have at least or precisely one regenerator 150 for each print bar 102.

In the example depicted in FIG. 1, the printing device 100 has two, possibly structurally identical, printing units 141, 142 that, for example, may be used for printing to the front side and back side of the recording medium 120. A turning unit (turner) 160 may be arranged between the two printing units 141, 142, which turning unit 160 is designed to turn the recording medium 120 so that the front side of the recording medium may be printed to by the first printing unit 141 and the back side of the recording medium 120 may be printed to by the printing unit 142.

As explained above, recording media 120 may exhibit disturbances, for example adhesive areas, joints, dog-ears, or other deformations. The printing gap between the surface of the recording medium 120 that is to be printed to and the nozzle plates of the one or more print heads 103 of the printing device 100 is typically relatively small, for example less than 2 mm, in order to achieve an optimally high print quality. Therefore, there is the risk that a damaged spot or disturbance of the recording medium 120 contacts, and possibly damages, the nozzle plate of a print head 103.

The printing device 100 may comprise a sensor 110 that is configured to detect an elevation of the recording medium 120 to be printed to. The sensor 110 may be arranged before the first printing unit 141, relative to the transport direction 1 of the recording medium 120. The controller 101 of the printing device 100 may be configured to interrupt a running printing process as soon as an elevation of the recording medium 120 is detected on the basis of the sensor data of the sensor 110. The detected elevation of the recording medium 120 may then be directed through the first printing unit 141 and through the optional second printing unit 142 without the recording medium 120 being printed to. A user of the printing device 100 may also be enabled to manually restart the printing process as soon as the detected elevation of the recording medium 120 has passed the one or more printing units 141, 142 of the printing device 100.

The aforementioned reaction of the printing device 100 to a detected elevation of the recording medium 120 leads to a relatively high expenditure for the user of the printing device 10, and/or to a relatively large amount of spoilage that must be rejected and discarded. Given a restart of the printing process, a cleaning of the one or more print heads 103, in particular a purging of the one or more print heads 103, within the one or more regenerators 150 is also typically necessary, which is linked with a relatively high ink consumption and with an additional time cost.

The one or more print bars 102, in particular the one or more print heads 103, may be designed such that the individual print bars 102 may be moved orthogonal to the surface of the recording medium 120 in order to increase the distance or the printing gap between the respective print bar 102 and the surface of the recording medium 120. This is depicted by arrows in FIGS. 2*a* through 2*c*, by way of example.

The controller 101 of the printing device 100 may be configured to have the effect, in reaction to a detected elevation 210 of the recording medium 120 to be printed to, that the individual print bars 102 of a printing unit 141, 142 are raised. The print bar 102 closest to the elevation 210 may thereby be set into motion first, and the following print bars 102 may then be raised gradually, as depicted by way of example in FIG. 2*b*.

After the elevation 210 has passed a print bar 102, this print bar 102 may be lowered again so that the print bars 102 of a printing unit 141, 142 are gradually lowered again, as depicted by way of example in FIG. 2*c*. The raising and the lowering of the print bars 102 may be effected in an especially energy-efficient and prompt manner via the sequential raising and/or lowering of the print bars 102. This enables the duration of the printing pause to be reduced.

FIG. 3 shows examples of time diagrams for the operation of the printing device 100 in reaction to a detected elevation 210. The elevation 210 is detected at a detection point in time 311. In reaction thereto, a printing pause signal 303 may be set by the controller 101. The printing pause signal 303 has a defined time length 333 that indicates the duration for which the printing operation of a printing unit 141, 142 should be paused due to the detected elevation 210.

FIG. 3 also shows the transport velocity 304 of the recording medium 120 as a result of the elevation 210 detected at the detection point in time 311. The transport velocity 304 is not reduced (at least in a first step). In other words, the recording medium 120 is invariably moved further within the printing device 100 even after detection of an elevation 210.

As emerges from FIG. 1, the first printing unit 141 exhibits a first spatial distance 131 from the sensor 110 for detection of elevations 210, and the optional second printing unit 142 exhibits a second spatial distance 132 from the sensor 110 for detection of elevations 210. The spatial distances 131, 132 correspond, depending on the transport velocity 304 of the recording medium 120, to time intervals 331, 332 between the sensor 110 and the respective printing unit 141, 142. In particular, the time intervals 331, 332 may be proportional to the spatial distances 131, 132, wherein the proportionality factor depends on the transport velocity 304, in particular corresponds to the transport velocity 304.

FIG. 3 shows a first control signal 301 for the first printing unit 141 and a second control signal 302 for the optional second printing unit 142. The first control signal 301 may be chronologically offset by the first time interval 331 relative to the printing pause signal 303, and may indicate the time period in which the first printing unit 141 implements a printing pause. The second control signal 302 may accordingly be chronologically offset by the second time interval 332 relative to the printing pause signal 303, and may indicate the time period in which the second printing unit 142 implements a printing pause.

FIG. 3 shows the beginning point in time 312 for the beginning of the printing pause for the first printing unit 141, and the end point in time 313 for the end of the printing pause for the first printing unit 141. Furthermore, FIG. 3 shows the beginning point in time 314 for the beginning of the printing pause of the second printing unit 142, and the end point in time 315 for the end of the printing pause of the second printing unit 142.

During the respective printing pause, the one or more print bars 102 of the respective printing unit 141, 142 may, as depicted in FIGS. 2*a* to 2*c*, initially be moved away from the surface of the recording medium 120 and, after traversal of the elevation 210, toward the surface of the recording medium 120 again, in order to reliably prevent a contact between the elevation 210 of the recording medium 120 and the nozzle plates of the respective print heads 103 in the one or more print bars 102.

As emerges from FIG. 3, the printing pauses of the individual printing units 141, 142 are time-limited. Following a printing pause, the printing operation may be resumed, in particular at the point at which the printing operation was interrupted. For example, a printing pause may have been begun following the printing of a defined page x of the usable print image to be printed. After ending the printing pause, the printing may be resumed with the printing of the directly following page x+1 of the usable print image.

The lower portion of FIG. 3 shows a time diagram in which the printing pause has a chronological duration 333 that enables the detected elevation 210 to be entirely guided through the first printing unit 141 and through the second printing unit 142 before the printing pause is ended again. This control of the printing device 100 may be efficiently realized via a controller 101 of the printing device 100.

The upper portion of FIG. 3 shows a time diagram in which the printing pause has a chronological duration 333 that enables the detected elevation 210 to be guided through precisely one printing unit 141, 142 before the printing pause is ended again. The printing pause for the respective printing unit 141, 142 may thereby be ended again as soon as the elevation 210 has traversed the respective printing unit 141, 142. The printing pause for a printing unit 141, 142 may thus be limited to the duration that the elevation 210 requires in order to traverse the respective printing unit 141, 142. An especially short printing pause may thus be enabled, whereby the effects of a detected elevation 210 of the recording medium may be further reduced, in particular with respect to spoilage and/or printing efficiency.

A usable print image to be printed by the printing device 100 may be subdivided into a sequence of pages. The individual pages may be identified via an index x, for example. The controller 101 may be configured to place the printing pause for a printing unit 141, 142—meaning the control signal 301, 302 for a printing unit 141, 142—in time, depending on the printing pause signal 303, such that the printing pause begins directly following the printing of a complete page x, so that the printing of the directly following page x+1 may be begun after the ending of the printing pause. In other words, the printing pause may be chronologically placed such that no incompletely printed page is printed on the recording medium 120 directly before the printing pause, and/or only completely printed pages are printed on the recording medium 120. A printing pause for a detected elevation 210 may thus be enabled in an especially resource-efficient manner.

The time interval 331, 332 and/or the duration of a printing pause, or of the corresponding control signal 301, 302, may thus be determined depending on

- the transport velocity 304 of the recording medium 120;
- the spatial distance 131, 132 between the sensor 110 and the respective printing unit 141, 142; and/or
- the arrangement of the individual pages x in the usable print image to be printed.

For example, the time interval 331, 332 T may be determined on the basis of the formula $$T=D/v-\Delta$$

wherein D is the spatial distance 131, 132, and wherein v is the transport velocity 304. Δ is a time offset that results from the fact that the printing pause is already begun after the ending of a completely printed page x, and not only at the most recent possible point in time at which a completely printed page x+1 is, however, present.

Accordingly, the duration Q of the printing pause or of the control signal 301, 302 may be determined on the basis of the following formula $$Q=R+\Delta$$

wherein R is the duration that the elevation 210 requires in order to traverse precisely one printing unit 141, 142 (for the instance depicted in the upper portion of FIG. 3), or in order to traverse both printing units 141, 142 (for the instance depicted in the lower portion of FIG. 3).

The controller 101 may be configured to induce a printing unit 141, 142 to print a trailer print image having one or more trailer pages after the ending of the printing of the page x of the print image and before the beginning of the printing pause. Alternatively or additionally, the controller 101 may be configured to induce a printing unit 141, 142 to print a leader print image having one or more leading pages after the ending of the printing pause and before the printing of the page x+1 of the print image. The one or more trailer pages and/or the one or more leader pages may be used by a post-processing unit of the printing device 100, for example by a cutter configured to cut out the individually printed pages of the usable print image, to synchronize with the printing device 100 and the inserted printing pause. For this purpose, the one or more trailer pages and/or the one or more leader pages may include a pattern that can be precisely and reliably detected by the post-processing unit. The insertion of one or more trailer pages and/or of one or more leader pages enables effects of a detected elevation 210 on the process for producing print products to be further reduced.

The ending and/or the beginning of the printing of a page of the usable print image may take place earlier or later by the duration that is required to print the one or more trailer pages or the one or more leader pages.

The printing device 100 may thus be configured to process a disturbance 210 of the recording medium 120 not as an error, with a printing stop following thereon, but rather as a status change that leads to a printing pause, in particular to a temporary and/or time-limited printing pause. One or more trailer pages may be inserted as needed, in particular before the beginning of the printing pause, so that a print good post-processing machine may more easily process the printing interruption and a synchronization to the print pages of the usable print image may subsequently take place.

The printing process in a printing unit 141, 142 is paused before the damaged spot 210 of the recording medium 120 reaches the first print bar 102 of the printing unit 141, 142. Given a printing device 100 having a plurality of printing units 141, 142, in particular for two-sided printing, the one or more following printing units 142 may continue to print without pause during the printing pause of the first printing unit 141. The recording medium 120 thereby continues to run at the full transport velocity 304.

The one or the plurality of print bar(s) 102, meaning the one of more print bars 102, of the first printing unit 141 are moved away from the surface of the recording medium 120 during the printing pause before the damaged spot 210 of the recording medium 120 has reached the respective print bar 102. The damaged spot 210 is then transported past the individual print bars 102. The individual print bars 102 may subsequently be moved toward the surface of the recording medium 120 again, and the printing process may be automatically continued again. The controller 101 may insert one or more leading pages as needed so that the post-processing may synchronize to the following pages of the usable print image.

In the further proceeding, given a printing device 100 having a plurality of printing units 141, 142, the damaged spot 210 of the recording medium 120 is transported to the second printing unit 142. Here as well, it proceeds as before in the first printing unit 141: the printing process is paused before the disturbance 210 arrives at a print bar 102 of the second printing unit 142. The respective print bar 102 is moved away from the surface of the recording medium 120, the recording medium 120 is transported by the respective print bar 102, and the respective print bar 102 is subsequently brought into printing position again. The printing process is continued at the correct page, matching the already printed usable print image of the first printing unit 141. The first printing unit 141 continues to print during the printing pause of the second printing unit 142.

If applicable, a simplified realization may be used, in particular for a duplex printing device 100, in which a damaged spot 210 is driven completely through the duplex printing device 100 until the second printing unit 142 has been traversed.

Upon detection of a disturbance 210 of the recording medium 120, the printing process may be paused. The print bars 102 of the one or more printing unit(s) 141, 142 are then moved away from the recording medium 120, and the disturbance 210 is driven at full transport velocity 304 through the complete printing device 100, in particular through all printing units 141, 142 of the printing device 100.

If applicable, the recording medium 120 may be stopped automatically along a stop ramp after the detected disturbance 210 has traversed the complete printing device 100. A relatively brief standstill of the recording medium 120 my then be produced. The printing process may subsequently be restarted automatically. The described measures may thus be particularly efficiently implemented. A user of the printing device 100 may thus also be made aware of the presence of a disturbance 210 of the recording medium 120.

The printing pause of a printing unit 141, 142 that has been produced due to a detected disturbance or elevation 210 may be brief, such that no purging of the one or more print heads 103 is required following the printing pause. The controller 101 may be configured to determine the duration of the printing pause of a printing unit 141, 142 or of a print head 103. For example, this may take place using the aforementioned formula. On the basis of the determined duration, a decision may then be made as to whether a purging of the print head 103 within the regenerator 150 is implemented following the printing pause, before resuming the printing operation, or whether no purging of the print head 103 is implemented. The effects of a detected elevation 210 on the productivity and/or on the efficiency of the printing device 100 may be further reduced by avoiding a purging of the print head 103.

FIG. 4 shows a workflow diagram of an example of a, possibly computer-implemented, method 400 for controlling a printing device 100, in particular an inkjet printing device 100, that has at least one printing unit 141, 142 having at least one print bar 102. The print bar 102 may have one print head 103 or a plurality of print heads 103, for example. The method 400 can be executed by a controller 101 of the printing device 100.

The printing device 100 is designed to produce a relative movement between the print bar 102 and/or the print head 103 and a recording medium 120 to be printed to by the print head 103, in order to print sequential lines of a usable print image onto the recording medium 120 during the printing operation. The relative movement may take place along a defined transport direction 1, wherein the transport direction 1 may travel orthogonal to the arrangement of the individual line of the usable print image. Within the scope of the relative movement, the recording medium 120 may be directed past a stationary print bar 102 and/or stationary print head 103. The recording medium 120 may be a recording medium 120 in the form of a web, a page, or a sheet.

The method 400 includes the detection 401 of an elevation 210 of the recording medium 120 to be printed to, in particular an elevation 210 that is larger or higher than the printing gap between the print bar 102 and/or the print head 103 and the recording medium 120. The elevation 210 may be detected on the basis of the sensor data of a sensor 110, wherein the sensor 110 is arranged before the printing unit 141, 142, in particular before the print bar 102 and/or the print head 103 of the printing unit 141, 142, relative to the transport direction 1.

Furthermore, in reaction to the detection 401 of an elevation 210, the method 400 includes effecting, in particular automatically effecting 402, a printing pause of the printing operation of the print bar 102 and/or of the print head 103 given continuation of the relative movement between the print bar 102 (and/or the print head 103) and the recording medium 120. In particular, the transport velocity 304 of the relative movement may thereby be maintained. On the other hand, the printing operation for printing of the usable print image is interrupted in the printing pause. The interruption thereby takes place at a defined point of the usable print image, in particular after ending the printing of a defined page of the usable print image.

The method 400 also includes effecting 403, in particular automatically effecting 403, that the printing gap between the print bar 102 (and/or the print head 103) and the recording medium 120 is enlarged during the printing pause so that the detected elevation 210 of the recording medium 120 may be directed past the print bar 102 (and/or the print head 103) within the scope of the continued relative movement. The enlargement of the printing gap may be produced by raising the print bar 102 (and/or the print head 103).

Furthermore, the method 400 includes effecting 404, in particular automatically effecting 404, that the printing gap between the print bar 102 (and/or the print head 103) and the recording medium 120 is reduced again after the detected elevation 210 of the recording medium 120 has been directed past the print bar 102 (and/or the print head 103). The reduction of the printing gap may be produced by lowering the print bar 102 (and/or the print head 103).

Moreover, the method 400 includes the resumption 405, in particular the automatic resumption 405, of the printing operation of the print bar 102 (and/or of the print head 103) to print the usable print image, and thus the ending of the printing pause, after the printing gap between the print bar 102 (and/or of the print head 103) and the recording medium 120 has been reduced. The printing of the usable print image may thereby be resumed directly following the defined point, in particular the defined page, of the usable print image at which the interruption of the printing of the usable print image previously took place.

Furthermore, in this document a controller 101 is described for controlling a printing device 100, in particular an inkjet printing device 100. The printing device 100 comprises at least one printing unit 141, 142 having at least one print head 103, and/or having at least one print bar 102 having one or more print heads 103. During the printing operation, a defined printing gap, for example with a gap width of 2 mm or less, may be present between the print bar 102 (and/or the print head 103) and a recording medium 120 to be printed to.

The printing device 100 may be designed to produce a relative movement between the print bar 102 (and/or the print head 103) and the recording medium 120 to be printed to by the print bar 102 (and/or the print head 103), in order to print sequential lines of a usable print image on the recording medium 120 during the printing operation. The usable print image may thereby comprise a sequence of pages that are printed sequentially, line by line, onto the recording medium 120 during the printing operation.

The controller 101 may be configured to detect an elevation 210 of the recording medium 120 to be printed to. In particular, an elevation 210 may thereby be detected that is larger or higher than the gap width of the printing gap between the print bar 102 (and/or the print head 103) and the recording medium 120. The printing device 100 may comprise a sensor 110, for example a camera, that is configured to capture sensor data with respect to the surface of the recording medium 120 that is to be printed to. The controller 101 may be configured to detect the elevation 210 of the recording medium 120 on the basis of the sensor data of the sensor 110. Relative to the transport direction 1 of the relative movement, the sensor 110 may be arranged at a defined spatial distance 331, 332 before the printing unit 141, 142, in particular before the print bar 102 (and/or the print head 103) of the printing unit 141, 142.

The controller 101 may also be configured to produce a printing pause of the printing operation in reaction to the detection of an elevation 210 of the recording medium 120. The relative movement between the print bar 102 (and/or the print head 103) and the recording medium 120 may thereby be continued, in particular during the entire printing pause. The printing operation of the print bar 102 (and/or the print head 103), in particular for printing of the usable print image, may also be interrupted during the printing pause.

Furthermore, the controller 101 may be configured to induce, during the printing pause, that the printing gap between the print bar 102 (and/or the print head 103) and the recording medium 120 is enlarged, in particular relative to the printing gap that is used during the printing operation. The enlargement of the printing gap may take place such that the detected elevation of the recording medium 120 may be directed past the print bar 102 (and/or the print head 103) within the scope of the continued relative movement without the print bar 102 (and/or the print head 103) thereby being contacted. For this purpose, the enlargement of the printing gap may be effected depending on the height of the elevation 210 as determined on the basis of the sensor data of the sensor 110. A negative effect on the print bar 102 (and/or the print head 103) due to the detected elevation 210 of the recording medium 120 may thus be prevented in an especially reliable and time-efficient manner.

The controller 101 may also be configured to induce that the print group between the printing unit 141, 142 and the recording medium 120 is reduced again after the detected elevation 210 of the recording medium 120 has been directed past the printing unit 141, 142 within the scope of the continued relative movement. The printing gap may thereby be reduced to the gap width provided for the printing operation.

In general, the printing unit 141 or 142 may have at least one print head. A plurality of print heads 103 for printing a single color may be arranged in a print bar 103.

Furthermore, the controller 101 may be configured to end the printing pause and resume the printing operation after the printing gap between the printing unit 141, 142 and the recording medium 120 has been reduced.

A controller 101 is thus described that is designed to detect an elevation 210 of a recording medium 120 to be printed to, by which elevation 210 the printing unit 141, 142 of a printing device 100 might be negatively affected. The controller 101 is also configured to automatically produce a time-limited printing pause of the printing unit 141, 142 in which the printing gap between the printing unit 141, 142 and the recording medium 120 is temporarily enlarged in order to direct the detected elevation 120 past the printing unit 141, 142. A negative effect on the printing device 100 given the presence of a damaged recording medium 120 may thus be efficiently and reliably avoided.

The controller 101 may be configured to determine the beginning point in time 312, 312 for beginning, or for the beginning of, the printing pause, and/or the end point in time 313, 314 for ending, or for the end of, the printing pause, depending on the spatial distance 331, 332 between the sensor 110 and the printing unit 141, 142, in particular the print bar 102 and/or the print head 103 of the printing unit 141, 142. The beginning point in time 312, 314 may thereby be determined such that the printing pause is begun before the detected elevation 210 of the recording medium 120 reaches the printing unit 141, 142, in particular the print bar 102 and/or the print head 103 of the printing unit 141, 142. Alternatively or additionally, the end point in time 313, 314 may be determined such that the printing pause is ended after the detected elevation 210 of the recording medium 120 has been directed past the printing unit 141, 142, in particular past the print bar 102 and/or the print head 103 of the printing unit 141, 142. A negative effect on the print bar 102 and/or the print head 103 of the printing unit 141, 142 may thus be reliably and efficiently prevented.

During the printing pause, the relative movement between the printing unit 141, 142 and the recording medium 120 has a defined transport velocity 304. The transport velocity 304 during the printing pause may thereby correspond to the transport velocity 304 during the printing operation, in particular without modification. The controller 101 may be configured to determine the beginning point in time and/or the end point in time of the printing pause especially precisely depending on the transport velocity 304 during the printing pause.

The controller 101 may be configured to induce the printing unit 141, 142 to print a trailer print image onto the recording medium 120 before the beginning of the printing pause and after interruption of the printing of the usable print image. Alternatively or additionally, the controller 101 may be configured to print a leader print image onto the recording medium 120 after ending the printing pause and before resuming the printing of the usable print image. The trailer print image and/or the leader print image may thereby respectively comprise a (possibly predefined) pattern that enables a post-processing device, for example a cutter, to identify the usable print image and/or locate the usable print image on the recording medium following the printing device 100. A reliable post-processing of a printed recording medium 120 may thus be enabled even given the presence of a defective recording medium 120.

The controller 101 may be configured to effect that the printing pause is begun only after conclusion of a completely printed page of the usable print image. This may in particular take place such that the printing of a page of the usable print image within the sequence of pages directly following the completely printed page may be begun after ending the printing pause, possibly directly after printing the optional leader print image. The printing pause may thus be inserted precisely with respect to the page within the sequence of pages of the usable print image. The effects of a defective recording medium 120 on the printing process may thus be further reduced.

The printing unit 141, 142 may have a plurality of successive print bars 102, for example for different colors and/or for different ink types. The printing device 100 may be designed such that, within the scope of the relative movement, the detected elevation 210 of the recording medium 120 is successively directed in a defined order, in particular along the transport direction 1, past the successive print bars 102 and/or the print heads 103 of the printing unit 141, 142.

The controller 101 may be configured to induce that, during the printing pause, the printing gaps between the successive print bars 102 and/or the successive print heads 103 and the recording medium 120 are respectively enlarged with a time offset relative to one another according to the defined order. The enlargement of the printing gaps may thereby in particular respectively take place "just in time" as the elevation 210 reaches the respective printing unit 141, 142. The enlargement of the printing gaps of the successive printing units 141, 142 may thus take place similar to a wave motion.

Alternatively or additionally, the controller 101 may be configured to induce that the printing gaps between the successive printing units 141, 142 and the recording medium 120 are respectively reduced, with a time offset relative to one another according to the defined order, as soon as the elevation 210 of the recording medium 120 has been directed past the respective printing unit 141, 142. The reduction of the gap width of the printing gaps may thereby respectively begin as soon as the elevation 210 has passed the respective printing unit 141, 142. The reduction of the printing gaps may thus take place in the reverse direction corresponding to the enlargement of the printing gaps, similar to a wave motion.

The sequential increase and/or decrease of the printing gap enables the duration of the printing pause to be further reduced, so that the effects of a defective recording medium 120 may be further reduced. Furthermore, the power requirement of the printing device 100 for the increase and/or decrease of the printing gap may thus be reduced.

The printing device 100 may comprise a first printing unit 141 having at least one first print bar 102, for example for printing to a front side of the recording medium 120. Furthermore, the printing device 100 may comprise a second printing unit 142 having at least one second print bar 102, for example for printing to the back side of the recording medium 120. The printing device 100 may be designed such that, within the scope of the relative movement, the detected elevation 210 of the recording medium 120 is first directed past the first print head 141 and subsequently past the second printing unit 142.

The controller 101 may be configured to produce a printing pause of the first printing unit 141, and to continue the printing operation in the second printing unit 142 while the detected elevation 210 of the recording medium 120 is being directed past the first printing unit 141. Alternatively or additionally, the controller 101 may be configured to produce a printing pause of the second printing unit 142, and to continue the printing operation in the first printing unit 141 while the detected elevation 210 of the recording medium 120 is being directed past the second printing unit 142. Time-limited printing pauses may thus be selectively produced for every single printing unit 141, 142. The effects of a defective recording medium 120 on the printing process may thus be reduced to a particular degree.

Alternatively, the controller 101 may be configured to produce a chronologically contiguous printing pause of the first printing unit 141 and of the second printing unit 142 that is sufficiently long in order to direct the detected elevation 210 of the recording medium 120 past the first printing unit 141 and past the second printing unit 142. A contiguous printing pause for a plurality of printing units 141, 142 may thus be produced which may be implemented in a printing device in an especially efficient and reliable manner.

The controller 101 may be configured to determine a duration of the printing pause before resuming the printing operation following the printing pause. In particular, the contiguous duration may be determined during which the printing unit 141, 142 was not used for printing a print image. Before resuming the printing operation, a regeneration measure of the printing unit 141, 142 may then be produced or suppressed depending on the determined duration of the printing pause. A high print quality of the printing device 100 may thus be efficiently ensured.

Furthermore, in this document a printing device 100 is described that comprises the controller 101 described in this document.

The duration of a printing interruption, i.e. a printing pause, due to a detected elevation 210 may be reduced via the measures described in this document, whereby the resource consumption and/or the spoilage may be reduced and/or the productivity of the printing device 100 may be increased. If applicable, a purging of the one or more print heads 103 of the printing device 100 following the printing pause may also be avoided via a time-reduced interruption of the printing operation, whereby the ink consumption may be reduced and the productivity of the printing device 100 may be further increased. Furthermore, manual interventions by a user of the printing device 100 may be avoided via the automatic insertion of a printing pause and via the automatic resumption of the printing operation, whereby the efficiency of the printing device 100 is further increased.

To enable those skilled in the art to better understand the solution of the present disclosure, the technical solution in the embodiments of the present disclosure is described clearly and completely below in conjunction with the drawings in the embodiments of the present disclosure. Obviously, the embodiments described are only some, not all, of the embodiments of the present disclosure. All other embodiments obtained by those skilled in the art on the basis of the embodiments in the present disclosure without any creative effort should fall within the scope of protection of the present disclosure.

It should be noted that the terms "first", "second", etc. in the description, claims and abovementioned drawings of the present disclosure are used to distinguish between similar objects, but not necessarily used to describe a specific order or sequence. It should be understood that data used in this way can be interchanged as appropriate so that the embodiments of the present disclosure described here can be implemented in an order other than those shown or described here. In addition, the terms "comprise" and "have" and any variants thereof are intended to cover non-exclusive inclusion. For example, a process, method, system, product or equipment comprising a series of steps or modules or units is not necessarily limited to those steps or modules or units which are clearly listed, but may comprise other steps or modules or units which are not clearly listed or are intrinsic to such processes, methods, products or equipment.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general-purpose computer.

For the purposes of this discussion, the term "processing circuitry" shall be understood to be circuit(s) or processor(s), or a combination thereof. A circuit includes an analog circuit, a digital circuit, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction (of the recording medium)
2 movement direction (of a print bar)
21, 22 nozzle
31, 32 column (of the print image)
100 printing device (printer)
101 controller
102 print bar
103 print head
110 sensor
131, 132 spatial distance
120 recording medium
122 processing circuitry
124 interface (input/output)
141, 142 printing unit
150 regeneration unit (regenerator)
160 turning unit (turner)
210 elevation (recording medium)
301 control signal for the first printing unit
302 control signal for the second printing unit
303 printing pause signal
304 transport velocity
311-315 points in time
331, 332 time interval
333 duration of the printing pause
400 method for operating a printing device given a detected recording medium elevation
401-405 method operations

The invention claimed is:

1. A controller for controlling a printing device that has at least one printing element having at least one printing unit, at least one print bar, and/or at least one print head, the printing device being configured to produce a relative movement between the printing element and a recording medium to be printed to by the printing element to print sequential lines of a usable print image onto the recording medium during a printing operation, the controller comprising:

an interface; and processing circuitry that is configured to:

detect at least one elevation of the recording medium to be printed to;

based on the detection, produce a printing pause of the printing operation upon continuation of the relative movement between the printing element and the recording medium;

induce, during the printing pause, an enlargement of a printing gap between the printing element and the recording medium so that the detected elevation of the recording medium directable past the printing unit within a scope of the continued relative movement;

induce a reduction in the printing gap between the printing element and the recording medium after the detected elevation of the recording medium has been directed past the printing unit; and resume the printing operation after the printing gap between the printing element and the recording medium has been reduced, wherein the processing circuitry is configured to induce the printing element to:

print a trailer print image onto the recording medium before beginning the printing pause and after interruption of the printing of the usable print image; and/or print a leader print image onto the recording medium after ending the printing pause and before resuming the printing of the usable print image; and the trailer print image and/or the leader print image comprise a pattern that is configured to enable a post-processing device following the printing device to identify the usable print image and/or locate the usable print image on the recording medium.

2. The controller according to claim 1, further comprising a sensor that is configured to acquire sensor data with respect to a surface of the recording medium that is to be printed to, the processing circuitry being configured to detect the at least one elevation of the recording medium based on the sensor data received via the interface.

3. The controller according to claim 2, wherein, relative to a transport direction of the relative movement, the sensor is arranged at a defined spatial distance before the printing unit.

4. The controller according to claim 3, wherein the processing circuitry is configured to determine a beginning point in time for beginning the printing pause and/or an end point in time for ending the printing pause, based on the defined spatial distance.

5. The controller according to claim 4, wherein the processing circuitry is configured to determine the beginning point in time for beginning the printing pause and/or the end point in time for ending the printing pause, based on the defined spatial distance, such that:

the printing pause is begun before the detected elevation of the recording medium reaches the printing unit, in particular the print bar and/or the print head of the printing unit; and/or the printing pause is ended after the detected elevation of the recording medium has been directed past the printing unit, in particular past print bar and/or past print head of the printing unit.

6. The controller according to claim 1, wherein:

the relative movement between the printing element and the recording medium during the printing pause exhibits a defined transport velocity;

the transport velocity during the printing pause corresponds to the transport velocity during the printing operation; and the controller is configured to determine a beginning point in time for the beginning of the printing pause and/or an end point in time for the ending of the printing pause, depending on the defined transport velocity.

7. A controller according to claim 1, wherein:

the usable print image comprises a sequence of pages; and the processing circuitry is configured to effect that the printing pause is started only after conclusion of a completely printed page of the usable print image such that the printing of a page of the usable print image directly following the completely printed page within the sequence of pages is started after ending the printing pause.

8. The controller according to claim 1, wherein:

the printing unit has a plurality of successive print bars and/or a plurality of successive print heads;

the printing device is configured such that, within the scope of the relative movement, the detected elevation of the recording medium is successively directed in a defined order past the successive print bars and/or a plurality of successive print heads of the printing unit; and the processing circuitry is configured to induce that, during the printing pause, the printing gaps between the successive print bars and/or the successive print heads and the recording medium are respectively enlarged according to the defined order with a time delay with respect to one another; and/or the processing circuitry is configured to induce that the printing gaps between the successive print bars and/or the successive print heads and the recording medium are respectively reduced according to the defined order with a time delay with respect to one another, as soon as the elevation of the recording medium has been directed past the respective print bar and/or past the respective print head.

9. The controller according to claim 1, wherein the printing device comprises a first printing unit having at least one print bar and/or having at least one print head, and a second printing unit having at least one print bar and/or having at least one print head;

the printing device is configured such that, within the scope of the relative movement, the detected elevation of the recording medium is directed first past the first printing unit and subsequently past the second printing unit; and the processing circuitry is configured to:

produce a printing pause of the first printing unit, and continue the printing operation in the second printing unit while the detected elevation of the recording medium is directed past the first printing unit; and produce a printing pause of the second printing unit, and continue the printing operation in the first printing unit while the detected elevation of the recording medium is directed past the second printing unit.

10. The controller according to claim 1, wherein:

the printing device comprises a first printing unit having at least one print bar and/or having at least one print head, and a second printing unit having at least one print bar and/or having at least one print head;

the printing device is configured such that, within the scope of the relative movement, the detected elevation of the recording medium is directed first past the first printing unit and subsequently past the second printing unit; and the processing circuitry is configured to produce a chronologically contiguous printing pause of the first printing unit and the second printing unit, the printing pause having a duration such that the detected elevation of the recording medium is directable past the first printing unit and past the second printing unit.

11. The controller according to claim 1, wherein the processing circuitry is configured to:

determine a duration of the printing pause before resuming the printing operation following the printing pause; and based on the determined duration of the printing pause, effect or suppress a regeneration measure of the print bar and/or of the print head before resuming the printing operation.

12. A method for controlling a printing device that has at least one printing element having at least one printing unit, at least one print bar, and/or at least one print head, the printing device being configured to produce a relative movement between the printing unit and a recording medium to be printed to by the printing unit to print sequential lines of a usable print image onto the recording medium during a printing operation, the method comprising:

detecting an elevation of the recording medium to be printed to;

based on the detection, producing a printing pause of the printing operation of the printing element given continuation of the relative movement between the printing element and the recording medium;

effecting, during the printing pause, an enlargement of a printing gap between the printing element and the recording medium so that the detected elevation of the recording medium is directable past the printing element within a scope of the continued relative movement;

effecting a reduction of the printing gap between the printing element and the recording medium after the detected elevation of the recording medium has been directed past the printing element;

resuming the printing operation of the printing element after the printing gap between the printing element and the recording medium has been reduced; and printing a trailer print image onto the recording medium before beginning the printing pause and after interruption of the printing of the usable print image, and/or printing a leader print image onto the recording medium after ending the printing pause and before resuming the printing of the usable print image, wherein the trailer print image and/or the leader print image comprise a pattern that is configured to enable a post-processing device following the printing device to identify the usable print image and/or locate the usable print image on the recording medium.

13. A non-transitory computer-readable storage medium with an executable program stored thereon, that when executed, instructs a processor to perform the method of claim 12.

14. A controller comprising processing circuitry that is configured to perform the method of claim 12.

* * * * *